United States Patent [19]

Svec

[11] 4,131,475

[45] Dec. 26, 1978

[54] FABRICATION OF SHELL INVESTMENT MOLDS

[75] Inventor: Paul S. Svec, Scotia, N.Y.

[73] Assignee: General Electric Company, Schenectady, N.Y.

[21] Appl. No.: 731,854

[22] Filed: Oct. 12, 1976

Related U.S. Application Data

[63] Continuation-in-part of Ser. No. 591,168, Jun. 27, 1975, abandoned.

[51] Int. Cl.[2] ..... B28B 7/34

[52] U.S. Cl. ..... 106/38.3; 106/38.35; 106/38.9

[58] Field of Search ..... 106/38.3, 38.9, 38.27, 106/38.35

[56] References Cited

U.S. PATENT DOCUMENTS

| | | | |
|---|---|---|---|
| 2,491,096 | 12/1949 | Feagin | 22/189 |
| 2,521,839 | 9/1950 | Feagin | 22/189 |
| 2,790,218 | 4/1957 | Kohl et al. | 22/193 |
| 3,436,235 | 4/1969 | Baer, Jr. et al. | 106/38.3 |
| 3,878,034 | 4/1975 | Bever et al. | 428/35 |
| 3,894,572 | 7/1975 | Moore, Jr. | 164/26 |

*Primary Examiner*—Lorenzo B. Hayes
*Assistant Examiner*—Amelia B. Yarbrough
*Attorney, Agent, or Firm*—Donald M. Winegar; Joseph T. Cohen; Charles T. Watts

[57] ABSTRACT

Investment casting molds embody an alumina-silica composition for at least the primary coatings which comprises a flour mixture consisting of at least two different sizes of fused alumina. The grain sizes range from approximately 240 mesh to approximately 400 mesh, U.S. Standard or Tyler screen series.

10 Claims, No Drawings

FABRICATION OF SHELL INVESTMENT MOLDS

CROSS-REFERENCE TO RELATED PATENT APPLICATION

This application is a continuation-in-part of Application Ser. No. 591,168, filed on June 27, 1975, now abandoned.

BACKGROUND OF THE INVENTION

1. Field of the Invention

This invention relates to the composition of the material of shell investment molds for casting and directionally solidifying nickel-base superalloys and high-temperature nickel-base eutetic materials which require the mold to be exposed to high temperatures (1680° C.-1700° C.) for extended periods of time of up to 24 hours.

2. Description of the Prior Art

Shell investment molds are employed to produce castings of a wide variety of alloys with a refractory material, compatable with the alloy being cast forming the inner mold wall. The secondary or back-up coats usually are composed of a high alumina-silicate refractory of an appropriate grain size to insure production of a useable mold. Long periods of time, up to 10 hours, coupled with high temperatures (1500° C.-1600° C.) caused undesirable mold defects, such as total collapse after casting the alloys, premature cracking and mold warpage. All of these, of course, produce undesirable and unacceptable castings. Mold-metal reactions, such as "pock marks", were also noted, suggesting that the inner or primary coats became contaminated with excessive amounts of $SiO_2$, $Na_2O$, and other fluxing agents which were not compatable with the alloy being cast.

An object of this invention is to provide a new and improved material for shell investment molds which overcomes the deficiencies of the prior art.

Another object of this invention is to provide a new and improved material for shell investment molds suitable for use in high-temperature mold applications (1680° C.-1700° C.).

Another object of this invention is to provide a new and improved alumina slurry to withstand the effects of mold-metal reactions at the mold-metal interface, such as required for the directional solidification of nickel-base superalloys and high-temperature nickel-base eutectic alloys requiring long solidification periods to obtain the desired cost structure.

Other objects of this invention will, in part, be obvious and will, in part, appear hereinafter.

BRIEF DESCRIPTION OF THE INVENTION

In accordance with the teachings of this invention, there is provided a material composition suitable for use in making shell investment molds. The material composition for at least the primary coating layers comprises a pre-selected weight of a flour mixture consisting of at least two different flour grain sizes of fused alumina. The grain sizes range from approximately 240 mesh to approximately 400 mesh, U.S. Standard or Tyler screen series.

A pre-selected weight of a colloidal silica is employed as a binder. In addition, a pre-selected volume of a wetting agent ranging from 8 to 12 cc per 100 lbs of slurry mixture may be added to the mixture. The ratio of weight percent of the flour to the binder is 73:27 to 65:35. Preferably, the fused alumina flour employed is acid-washed to remove free iron contamination resulting from its manufacture and has an $Al_2O_3$ purity of greater than 98%. This is important where high quality surface finishes for turbine components are desired. The weight percent of silica in the colloidal silica binder is from 15 to 36 percent.

When a flour mixture consists of two different flours, the ratio of the larger grain to the smaller grain flour may vary from between 10:90 and 90:10. When the mixture consists of three different flour sizes, the first or coarse flour comprises from 70 to 75% weight percent of the mixture, the second flour comprises from 10 to 20%, and the third or smallest grain size flour comprises the remainder.

DESCRIPTION OF THE PREFERRED EMBODIMENT

Unexpectedly, I have found that a mixture of two or more flour sizes of fused alumina provide an excellent material composite for the one or more primary costs required to form a suitable inner mold wall for the casting of metal therein, particularly a superalloy metal, and the directional solidification thereof. Fused alumina flour sizes are closely controlled by the manufacturer, since they are basically produced for other uses. Therefore, a mixture of two or more fused alumina flours is preferred to acquire a grain size distribution to decrease voids at the metal-mold interface and to produce a slurry in which settling of the refractory flour is nil. Fused alumina is chosen because of its inherent low expansion and contraction properties, high temperature capability, and resistance to attack by the materials being cast.

Preferably, the flour is a high-purity alumina greater than 98% by weight $Al_2O_3$. The flour, when the mold is employed for the casting and directional solidification of turbine components having a high standard of surface finish requirements, is acid-washed to remove impurities, such as iron, which is detrimental to the formulation of a suitable primary slurry. Grain sizes must be considered since surface finish of molds and mold permeability is important when an acceptable casting is desired. A flour mixture containing a high percentage of large grains will produce a rough inner mold wall. This roughness is reproduced on the casting surface. A flour containing a large percentage of "fines" requires an excessive amount of binder and usually causes mold wall "buckling".

The colloidal silica binder is available as a commercial product Nalcoag and contains 36% silica by weight. Nalcoag is a tradename of colloidal silica binder sold by the Nalco Chemical Company. This colloidal solution is diluted with de-ionized water to vary the silica content from 36% by weight to 15% by weight. I prefer to dilute the binder to 18% by weight, preferably by using deionized water, and employ this diluted binder in the primary slurry. Total percentage of diluted binder may vary from 27% by weight to 35% by weight of the total slurry, depending on the flour mixture employed.

Other slurry additions are required. A wetting agent to ensure proper wetting of the wax pattern by the slurry. I prefer a non-ionic wetting agent since these are compatable with the binder (colloidal silica) employed. These agents are readily available commercially. Also, a defoaming agent may be required if excessive foam is noted on the slurry during the mixing operation. If good slurry mixing practices are followed, foaming will not be a serious problem. I have employed Antifoam 60, manufactured by the General Electric Company, in the amount of 0.005% by weight to 0.008% by weight of the slurry, directly to the slurry. I have found 8cc to 12cc of wetting agent per 100 lbs. total weight of the slurry will induce good wetting properties to the slurry.

The primary flour mixture is prepared by blending the two or more alumina flours together for a period of time to assure one of achieving a good mixture of the flour sizes. I prefer to blend each of my flour mixtures for a period of at least one hour. I then prepare my colloidal silica solution and pour it into my mixing vessel, usually of stainless steel material construction. I then add about 90% by weight of my blended flour mixture to the colloidal silica solution. The flour and colloidal silica solutions are then mixed until the viscosity of the resulting slurry becomes stabilized.

The remaining blended flour mixture is then added to the mixture and the mixing, or stirring action, is continued for a period of time to ensure a good mixture. One may allow mixing to continue overnight as a means of convenience, or for a period of up to about 10 hours therefor.

The specific gravity of the mixture is checked and adjusted to fall within a range of 2.20 and 2.45. If the specific gravity is too low, below 2.20, I add amounts of alumina flour comprising of the flour mixture to increase the specific gravity of the mixture. Should the specific gravity be greater than 2.45 one may add small amounts of the colloidal silica solution to achieve the desired range of specific gravity.

The viscosity of the primary slurry is adjusted to fall within a range of from 5 to 20 seconds with a #5 Zahn cup. Preferably, a range of from 7 to 10 seconds as measured with the #5 Zahn cup is desired. Adjustments are made in the same manner as that employed in adjusting to the specific gravity range.

The following flour mixtures have been employed and yield satisfactory primary slurries. All percentages are by weight percent and all flours are fused alumina, U.S. Standard sieve size, acid washed. The mesh designations are also employed by the Norton Company and are understood by those skilled in the art to designate a flour material that is almost entirely of a particular size. Further, it is also understood by those skilled in the art that the alumina particles have passed through the openings of a screen size for the specific purpose of sizing the material.

| | |
|---|---|
| Mix #1 | Mix #6 |
| 240 mesh 50% | 240 mesh 65% |
| 400 mesh 50% | 320 mesh 35% |
| Mix #2 | Mix #7 |
| 240 mesh 66% | 240 mesh 85% |
| 320 mesh 34% | 400 mesh 15% |
| Mix #3 | Mix #8 |
| 240 mesh 50% | 240 mesh 70% |
| 320 mesh 50% | 320 mesh 25% |
| | 400 mesh 5% |
| Mix #4 | Mix #9 |
| 240 mesh 90% | 240 mesh 85% |
| 320 mesh 10% | 320 mesh 15% |
| Mix #5 | Mix #10 |
| 320 mesh 90% | 240 mesh 10% |
| 400 mesh 10% | 320 mesh 90% |

Unsatisfactory primary resulted when the following mixtures were employed:

Mix #11: 240 mesh 100%, Mix #12: 320 mesh 100%.

Primary slurries containing 100% 240 mesh $Al_2O$ flour produced fragile shells which cracked on dewaxing. Penetration of molten metal and casting roughness, which was unacceptable, resulted when the molds which did not crack on dewaxing were employed. Primary slurries containing 100%, 320 grain size flour, were difficult to keep in suspension without excessive stirring and produced mold defects such as mold wall "buckling".

I prepare my secondary slurry in the same manner. Since the material of the secondary slurry material is employed to add strength to the mold, the slurry may comprise alumina of a single size or a mixture of two or more alumina flour sizes. The flour sizes may be of the same range as that of the primary slurry or of slightly larger sizes. Preferably, the same flour mixture of the primary slurry may be used for the makeup of the secondary slurry. The binder is commercially available colloidal silica, of which 36 percent by weight is silica. Alternately, some of the primary slurry is utilized as a secondary slurry by adjusting the specific gravity and viscosity to the desired range for the secondary slurry. The adjustment is the same as that practiced for preparing the primary slurry. The specific gravity is adjusted to fall in a range from 1.9 to 2.2. The viscosity is adjusted to fall within a range of from 5 to 15 seconds as measured with a #5 Zahn cup. A range of from 6 to 7 seconds as measured by a #5 Zahn cup is desirable.

Grain or sand coats are employed between each slurry coating layer, to help bind mutually adjacent slurry layers together. No binder material is employed. Each grain or sand coat consists of fused alumina material and the ranges are from 70 to 100 mesh size for primary slurry coatings and from 36 to 54 mesh for secondary slurry coatings. The grain or sand coats are applied to each drained coated waxed pattern, as required, by immersing the same in a fluidized bed of the fused alumina material. The fused alumina material is also available from the Norton Company.

In preparing an investment mold I prefer to coat each pattern with at least two coats of primary slurry material. However, when desired, more than two primary slurry coats may be applied to the pattern. A sand, or grain coat of the applicable grain size is applied between each slurry coating.

Excess slurry material is allowed to drain from pattern before applying a sand or grain coating. The pattern now coated with the primary slurry and sand is allowed to air dry for at least 1.5 hours before applying another coat. Longer times may be necessary when undesirable drying conditions exist, i.e. high humidity.

I prefer to apply two primary coats, each consisting of a primary slurry application and a primary sand or grain application. Then a plurality of secondary coatings after the primary coatings are dried enough to accept them.

I prefer at least four secondary coatings to achieve the desired mold strength. After each secondary slurry application a sand or grain coat is applied. Each application of slurry and sand or grain is allowed to air dry at least 1 hour.

A "seal coat" consisting of the secondary slurry mixture is applied over the final sand or grain coat. The purpose of the "seal coat" is to keep the last sand or grain coat in place.

The completed shell investment mold for the desired application of casting and directional solidification of superalloys therein is dried at room temperature. Preferably, air drying at room temperature is continued for at least 12 hours. Therefore, one may accomplish this end by air drying the mold overnight before dewaxing.

The air dried shell molds are dewaxed by any standard technique known to those skilled in the art. I have used the "flash dewax" technique. In this technique, the air dried molds are placed directly into a furnace that has been preheated to 1000° C. ± 25° C.

As the wax melts it vacates the mold. The mold is left in this oxidizing environment, at 1000° C. in air, for 1.5 hours. The heat source is then turned off and the molds are allowed to furnace cool. The material composition of the shell is now $Al_2O_3+SiO_2$. The completed shell mold may be used immediately or stored for future use.

Shell investment molds fabricated in the manner described heretofore are pre-heated to 1680° C.–1700° C. and the superalloy materials previously described are cast therein and directionally solidified. The resulting castings are superior in quality of surface finish and composition of matter than those obtained by use of prior molds.

It has been discovered that the novel mold compositions, particularly the compositions of the primary slurry coatings, enable the formation of a metal-mold barrier layer to be formed. It is this novel barrier, which is formed in a controlled prevailing furnace atmosphere, that is reducing for silica, which enables excellent surface finished to be obtained for the castings. The reducing atmosphere enables alumina to dissolve into the silica and remove the silica from the mold-metal interface.

Upon final firing of the material the primary and secondary coatings have approximately the following composition:

(1) Primary coating the alumina to silica ratio by weight percent is from about 88:12 to approximately 95:5.

(2) Secondary coating the alumina to silica ratio by weight percent is from about 84:16 to approximately 93:7.

Overall, alumina comprises from 80 to 99:9 percent by weight of the total mold material after drying.

The following is illustrative of the preparation of primary and secondary slurry compositions of this invention.

EXAMPLE I

I have selected Mix #4 containing 240 mesh fused alumina at 90% and 320 mesh fused alumina at 10% by weight of the flour mixture as a particular illustration. Total weight of the slurry (flour and binder) was 100 lbs. The dry flours were blended together for approximately ½ hour. Total weight of the binder was 27% by weight. The binder was collodial silica diluted with de-ionized water to 18% by weight silica content. Therefore, 27 lbs. of this mixture was diluted binder and 73 lbs. was flour mixture #4.

Approximately 90% of the total weight of the flour mixture was added to all of the binder which was contained in a suitable mixer. The constituents were mixed together until the viscosity of the slurry became stabilized. The slurry of flour and binder were allowed to mix slowly overnight.

After mixing overnight, the specific gravity and viscosity of the slurry was checked. The specific gravity was adjusted to a range of from about 2.36 to about 2.42 and a viscosity range of from 7 to 10 seconds with a #5 Zahn cup. Any adjustment made at this time to bring the specific gravity and the viscosity to within the desired levels was accomplished as previously described. Additionally, a defoamer was added, in amounts previously stated to prevent excess foaming.

A wetting agent was added only after the specific gravity and viscosity were at the desired levels for the slurry. An amount of 10cc wetting agent was added to the 100 pounds of slurry mixture to induce good wetting properties. Upon adding the wetting agent the slurry was mixed for about 10 to 15 minutes to ensure a good distribution of the wetting agent throughout the slurry.

Several wax patterns were fabricated, cleaned and dried by standard established procedures well known to those skilled in the art. The wax patterns were then dipped into the primary slurry and the excess slurry was allowed to drain. When draining was completed, the bubble-free slurry coat was ready for graining. Graining was accomplished by means of fluid bed equipment. The coated pattern was immersed in the fused alumina for about 15 seconds. The graining or sand coat material was 70 grain fused alumina, acid washed, of 98% or greater purity. This particular size grain formed an excellent grain coat to receive the next slurry dip coat. The coated wax patterns were allowed to air dry at room temperature for at least two hours.

When properly dried, the coated wax patterns were again dipped in the primary slurry and were again coated with the 70 grain $Al_2O_3$. The coated patterns were allowed to dry in air at room temperature for at least two hours. This procedure completed the application of the two primary coats which I prefer in making an investment mold.

Secondary slurry coats were then applied after the primary coats were dry enough to accept them. This application was made about two hours after the last primary coat was applied to the coated molds. The secondary grain coats and slurry coats were applied in the same manner as the primary grain and slurry coats. However, the composition differed. For this shell mold composite the secondary slurry consisted of only 240 mesh fused alumina flour, acid washed, and 36 grit size fused alumina as the grain coat. Four secondary slurry coats were applied to each of the coated patterns and one 36 grain coat application between each secondary coating. The binder was colloidal silica, of which 36 percent by weight was silica. The ratio of undiluted binder solution to flour mixture was 30:70. For secondary slurry had its specific gravity adjusted to from about 1.9 to about 2.1 and its viscosity adjusted to approximately 6–7 seconds as measured with a #5 Zahn cup.

A "seal" coat consisting of the secondary slurry mixture was applied as the final coat. The purpose of the seal coat was to keep the last grain coat in place.

The completed shell molds were dried at room temperature, by allowing them to dry overnight.

The wax pattern was removed from each shell mold by the "flash dewax" technique. After dewaxing, the shells were fired in air at 1000° C. for 1.5 hours and were then allowed to furnace-cool. The shell molds were then stored for use in the casting and solidification of a superalloy material.

The completed shell investment molds fabricated in the manner described heretofore were pre-heated to 1680° C.–1700° C. and a superalloy material, a tantalum carbide-reinforced eutectic alloy with a high nickel content (NiTaC-13) previously described were cast therein and directly solidified. The resulting castings were superior in quality of surface finish and in composition of matter than those obtained by use of prior art molds.

EXAMPLE II

Alumina-silica investment shell molds were prepared in the same manner as those of the Example I and the ingredients and requirements were as follows:

1. Primary Slurry
   a) Equal parts by weight of 400 and 320 mesh fused alumina flour, acid washed (Norton Company), total weight 66⅔ pounds.
   b) Colloidal silica solution (Nalcoag) 18% by weight of solution being silica, total weight 33⅓ pounds.
   c) Viscosity — 16 to 20 seconds, #5 Zahn Cup
   d) Specific gravity — 2.2 to 2.4
   e) Wetting agent — 10cc (ultra wet)
   f) Grain coat — fused alumina, 70 mesh (Norton Company)
2. Second Slurry
   a) Fused alumina flour size and quantity the same as in Primary Slurry.
   b) Colloidal silica solution (Nalcoag), 36% by weight of solution being silica
   c) Viscosity — 10 to 12 seconds, #5 Zahn Cup
   d) Specific Gravity — 2.0 to 2.2
   e) Wetting agent — 10cc (ultra wet)
   f) Grain Coat — fused alumina, 36 mesh (Norton Company)

The resulting investment shell molds performed well and excellent metal castings resulted.

I have described in particular a novel investment shell mold of various alumina-silica compositions for both the primary and secondary slurry coatings. However, these molds are desirable for use with superalloy metals employed in making blades for aircraft jet engines. It is to be noted that it is the primary slurry coating which enables one to obtain the desired finish and composition of the metal cast in the mold. The secondary slurry coating provides the strength for the mold. When high temperature strength is not required, the secondary slurry coating may comprise other suitable materials such, for example, as fire clay and other Alumino-Silica refractory grains composed of Silica, Alumina, Ferric Oxide, titanio and lime depending upon the elevated temperatures and time at temperature to be encountered by the mold.

The alumina-silica mold compositions of this invention and processes embodying the same, have been described with reference for employment for the making of turbine components. It is essential that iron contaminent be absent from the primary coating slurry as they may cause defective surface finishes of the cast component at the mold-metal interface. To prevent any accidental inclusion of iron contaminents in such cast components all fused alumina flours for both primary and secondary slurries are specified to be acid - washed to remove impurities such as iron. Therefore, when such surface finish requirements are not needed, or a lesser degree of quality standard can be tolerated, ordinary fused alumina flour material may be employed for either or both of the primary and secondary slurry material compositions.

Particularly, it has been discovered that the novel mold compositions, particularly the compositions of the primary slurry coatings, enable the formation of a metal-mold barrier layer to be formed when casting superalloy metals therein. It is this novel barrier, which is formed during directional solidification in a controlled prevailing furnace atmosphere at temperatures of about 1700° C. to 1850° C., that is reducing for silica, which enables excellent surface finishes to be obtained for the castings. The reducing atmosphere enables alumina to dissolve into the silica and remove the silica from the mold-metal interface.

I claim as my invention:

1. An investment mold suitable for the casting and solidification of a superalloy therein comprising:
- a plurality of first layers of a first type alumina-silica coating material disposed one upon the other;
- at least a portion of one surface of one of the first layers defining at least one cavity in the mold for the casting of a melt of metal therein;
- the first type coating material is derived from a mixture of three different fused alumina flour grain sizes 70–75% by weight of the mixture of 240 mesh; 10–20% by weight of the mixture of 320 mesh, and the remainder 400 mesh, wherein the alumina to silica ratio, in weight percent, upon final firing of the mold is from about 88:12 to about 95:5;
- a plurality of second layers of a second type alumina-silica coating material disposed upon each other and upon the pluraity of first layers, to strengthen the mold, and
- a sand coat of a fused alumina material disposed between and binding together mutually adjacent coating material layers.

2. The investment mold of claim 1 wherein
the purity of the alumina is greater than about 98%.

3. The investment mold of claim 2 wherein
the alumina is substantially free of iron contamination.

4. The investment mold of claim 1 wherein
the second type coating material comprises an alumina-silica material composition wherein the alumina is derived from a fused alumina flour having a flour grain size which is at least one selected from the group consisting of 240 mesh, 320 mesh and 400 mesh, and wherein
the alumina to silica ratio, in weight percent, upon final firing of the mold is from about 84:16 to about 93:7.

5. The investment mold of claim 4 wherein
the alumina flour of the second type alumina-silica coating material is derived from a mixture of
two different fused alumina flour grain sizes.

6. The investment mold of claim 5 wherein
the ratio of the two different flour grain sizes to each other by weight in the second type alumina-silica coating material is from about 10:90 to about 90:10.

7. The investment mold of claim 5 wherein
the at least two flour grain sizes in the second type alumina-silica coating material are selected from the group consisting of 240 mesh, 320 mesh and 400 mesh.

8. The investment mold of claim 5 wherein
the alumina present in the second type alumina-silica coating material is derived from a mixture of three different fused alumina flour sizes,
the 240 mesh size flour comprises from 70 to 75 percent by weight of the alumina flour mixture,
the 320 mesh size flour comprises from 10 to 20 percent by weight of the alumina flour mixture, and
the 400 mesh size flour comprises the remainder of the alumina flour mixture.

9. The investment mold of claim 4 wherein
the purity of the alumina in each type coating material is greater than about 98%.

10. The investment mold of claim 9 wherein
the alumina is substantially free of iron contamination.

* * * * *